US012352462B2

(12) United States Patent
Bastiand

(10) Patent No.: US 12,352,462 B2
(45) Date of Patent: Jul. 8, 2025

(54) AIR HANDLING UNIT

(71) Applicants: Patrice Bastiand, Conjux (FR); Carrier Corporation, Palm Beach Gardens, FL (US)

(72) Inventor: Patrice Bastiand, Conjux (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 603 days.

(21) Appl. No.: 17/055,212

(22) PCT Filed: May 15, 2018

(86) PCT No.: PCT/IB2018/000700

§ 371 (c)(1),
(2) Date: Nov. 13, 2020

(87) PCT Pub. No.: WO2019/220164

PCT Pub. Date: Nov. 21, 2019

(65) Prior Publication Data

US 2021/0222910 A1 Jul. 22, 2021

(51) Int. Cl.

| | |
|---|---|
| ***F24F 13/30*** | (2006.01) |
| ***F24F 3/00*** | (2006.01) |
| ***F24F 13/22*** | (2006.01) |

(52) U.S. Cl.

CPC ..... *F24F 13/30* (2013.01); *F24F 13/222* (2013.01); *F24F 3/00* (2013.01)

(58) Field of Classification Search

CPC ..... F24F 13/30; F24F 13/222; F24F 3/00; F24F 1/36; F24F 13/22; F28F 17/005; F28B 9/08

See application file for complete search history.

(56) References Cited

U.S. PATENT DOCUMENTS

| | | | |
|---|---|---|---|
| 1,684,558 | A | 9/1928 | Schwarz |
| 2,048,282 | A | 7/1936 | Neeson et al. |

(Continued)

FOREIGN PATENT DOCUMENTS

| | | | |
|---|---|---|---|
| CN | 201103961 | Y | 8/2008 |
| CN | 103115398 | A | 5/2013 |

(Continued)

OTHER PUBLICATIONS

WO-2018104990-A1 English Translation (Year: 2018).*

(Continued)

*Primary Examiner* — Frantz F Jules
*Assistant Examiner* — Devon Moore
(74) *Attorney, Agent, or Firm* — CANTOR COLBURN LLP

(57) ABSTRACT

This air handling unit (1) comprises an enclosure (3) in which air circulates along a flow direction (X), at least one heat exchanger (5) mounted in the enclosure (3), a condensate recuperator (15) placed under the at least one heat exchanger (5), and a support member (13, 19) stationary with respect to the enclosure (3), and which supports the condensate recuperator (15). The air handling unit (1) comprises a stop member (21) attached to the heat exchanger (5), and cooperating with a portion (132) of the support member (13, 19), the heat exchanger (5) is mounted in the recuperator (15), and an ensemble formed by the heat exchanger (5) and the recuperator (15) is blocked with respect to the support member (13) longitudinally to the flow direction (X) during transportation by the stop member (21).

8 Claims, 11 Drawing Sheets

(56) References Cited

U.S. PATENT DOCUMENTS

| | | | |
|---|---|---|---|
| 4,000,779 | A | 1/1977 | Irwin |
| 4,474,029 | A | 10/1984 | Kennon |
| 4,474,232 | A | 10/1984 | Wright et al. |
| 4,907,420 | A | 3/1990 | Mahanay et al. |
| 5,195,332 | A | 3/1993 | Sullivan |
| 5,505,070 | A | 4/1996 | Rude et al. |
| 5,664,430 | A | 9/1997 | Karman |
| 5,694,785 | A | 12/1997 | Balentine |
| 6,345,511 | B1 | 2/2002 | Esty et al. |
| 6,895,770 | B1 | 5/2005 | Kaminski |
| 6,901,766 | B1 | 6/2005 | Jin et al. |
| 7,228,698 | B2 | 6/2007 | Sanders |
| 7,587,904 | B2 | 9/2009 | Sanders |
| 8,869,548 | B2 | 10/2014 | Piccione |
| 9,664,461 | B2 | 5/2017 | Mercer et al. |
| 2007/0169493 | A1 | 7/2007 | Rios |
| 2012/0000231 | A1 | 1/2012 | Lafontaine |
| 2017/0159967 | A1 | 6/2017 | Kawanori et al. |
| 2017/0191734 | A1* | 7/2017 | Grantham ..... F24F 13/222 |
| 2018/0180318 | A1* | 6/2018 | Shiomi ..... F24F 13/30 |

FOREIGN PATENT DOCUMENTS

| | | | | |
|---|---|---|---|---|
| JP | H10318660 | A | 12/1998 | |
| JP | 2012013404 | A | 1/2012 | |
| WO | 2007012160 | A2 | 2/2007 | |
| WO | 2007012161 | A2 | 2/2007 | |
| WO | 2012028469 | A2 | 3/2012 | |
| WO | WO-2018104990 | A1 * | 6/2018 | ..... F24F 1/22 |

OTHER PUBLICATIONS

Chinese Office Action for Application No. 201880093453.X; Issued Jun. 21, 2021; 7 Pages.

International Search Report and Written Opinion for Application No. PCT/IB2018/000700; Issued Jan. 31, 2019; 10 Pages.

Indian Office Action for Application No. 202017046838, Issued Jun. 16, 2022, 5 Pages.

* cited by examiner

AIR HANDLING UNIT

CROSS-REFERENCE TO RELATED APPLICATIONS

This application is a 371 U.S. National Stage application of PCT/IB2018/000700, filed May 15, 2018, which is incorporated herein by reference in its entirety.

The present invention concerns an air handling unit.

Air handling units are adapted to treat the air: filtering, depolluting, humidifying, drying, heating, cooling, or the like. Some air handling units adapted to produce cooled air for air conditioning comprise heat exchangers which may cause condensation of the humidity in treated air. In air conditioning applications, it is known to place a condensate tray below the heat exchanger to drain condensate outside the enclosure. Such condensate tray cannot be removed or cleaned. State-of-the art air handling units comprise a recuperator placed below the heat exchanger to recuperate the condensed liquid, and a removable tray adapted to receive the condensate coming from the recuperator thanks to a slight slope of the recuperator.

Standard air handling units have a recuperator that is held by a support member under the recuperator. The heat exchanger is mounted on the recuperator such that the weight of the heat exchanger is borne by the recuperator.

During transportation of the assembled air handling unit, mechanical stresses are exerted by the weight of the heat exchanger bearing on the recuperator. Most importantly, the heat exchanger may move along the air flow direction, leading to shocks against side walls of the recuperator. As the recuperator is generally made of a folded sheet metal with the side walls welded to each other, damages to the welding may occur and cause tightness issues.

The aim of the invention is to provide a new air handling unit, in which the mechanical structure prevents mechanical stresses on the condensate recuperator.

To this end, the invention concerns an air handling unit comprising:

- an enclosure in which air circulates along a flow direction;
- at least one heat exchanger mounted in the enclosure;
- a condensate recuperator placed under the at least one heat exchanger;
- a support member stationary with respect to the enclosure, and which supports the condensate recuperator.

This air handling unit is characterized in that it comprises a stop member attached to the heat exchanger, and cooperating with a portion of the support member, and in that the heat exchanger is mounted in the recuperator, and an ensemble formed by the heat exchanger and the recuperator is blocked with respect to the support member longitudinally to the flow direction during transportation by the stop member.

Thanks to the invention, in case of movement of the heat exchanger along the longitudinal direction and air flow direction of the air handling unit, all the weight of the heat exchanger is not any more borne by the recuperator but by another part whose tightness is not critical, allowing reduction of mechanical stresses on the recuperator and reduction of potential tightness issues on the recuperator.

According to further aspects of the invention which are advantageous but not compulsory, such an air handling unit may incorporate one or several of the following features:

- The stop member comprises sliding means interfacing with sliding means of the support member so that the ensemble formed by the heat exchanger and the recuperator is able to slide with respect to the support member transversal to the flow direction.
- The support member comprises a portion extending transversally to the flow direction and bearing the sliding means.
- The sliding means of the stop member and the sliding means of the support member have transversal sections of complementary shape.
- The sliding means of the stop member and the sliding means of the support member have transversal sections of "V" shape.
- The stop member is formed by a part extending transversally to the flow direction and attached to a bottom portion of the heat exchanger.
- The air handling unit comprises a holding structure mounted on the support member and on which the recuperator rests so that the recuperator is able to slide on the holding structure.
- The stop member is made of folded sheet metal.
- The air handling unit comprises a condensate tray adapted to receive condensate from the recuperator, and wherein the support member comprises a cut-out allowing removable insertion of the condensate tray.

The invention will now be explained in reference to the annexed drawings, as an illustrative example. In the annexed drawings.

Figure 1:
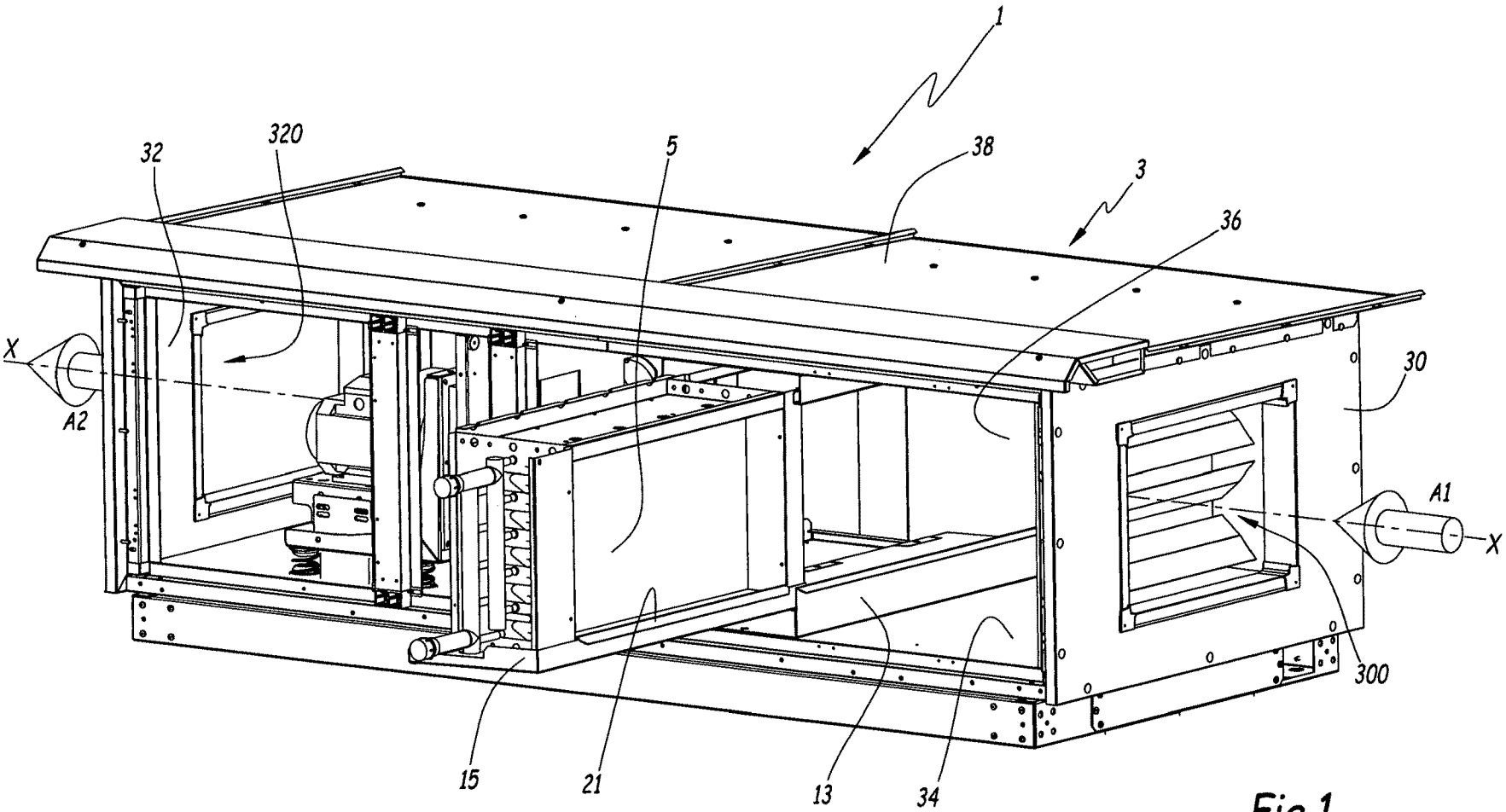
FIG. 1 is a perspective view of an air handling unit on which a lateral panel is omitted, and in which a heat exchanger is being inserted.

An air handling unit 1 is shown on FIG. 1. The air handling unit 1 comprises an enclosure 3 extending along a longitudinal axis X. The enclosure 3 is delimited by panels comprising an entry panel 30 and an exit panel 32, each provided with an opening 300 and 320. In this example, an air flow enters the enclosure 3 through the opening 300 along arrow A1, and exits through the opening 320 along arrow A2. The air flow circulates along a flow direction corresponding to the longitudinal axis X. The invention is not limited to this type of air path, and various other air paths can be used, including double flow in some air handling units. The enclosure 3 also comprises longitudinal panels comprising a bottom panel 34, a rear panel 36 and a top panel 38, that extend parallel to the longitudinal axis X. The enclosure 3 also comprises a front panel which is omitted to show the inner side of the enclosure 3.

The air handling unit 1 comprises at least one heat exchanger 5 mounted in the enclosure 3. The heat exchanger 5 extends transversally to the air flow direction X. As an example, the heat exchanger 5 may be an evaporator, with refrigerant flowing inside the heat exchanger to cool the air. The heat exchanger 5 may also be a water heat exchanger, with cooled water flowing inside, or any other type.

Figure 2:
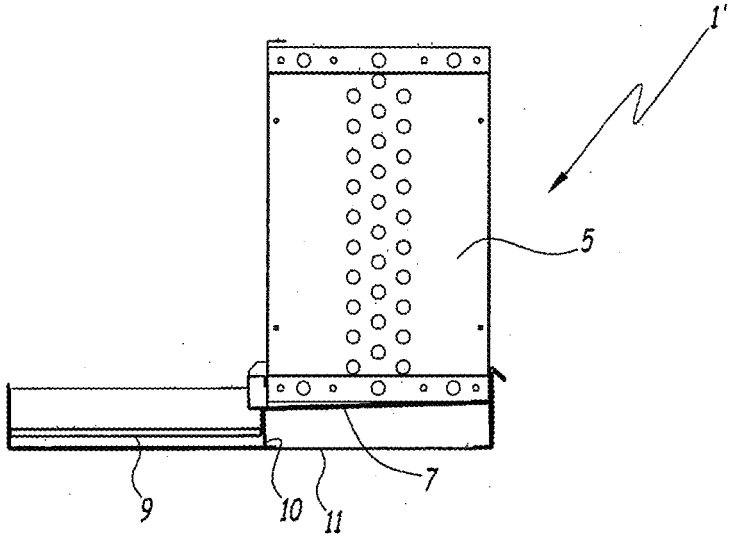
Fig.2 PRIOR ART
FIGS. 2, 3 and 4 represents three sectional views of various parts of a known air handling unit.
Figure 3:
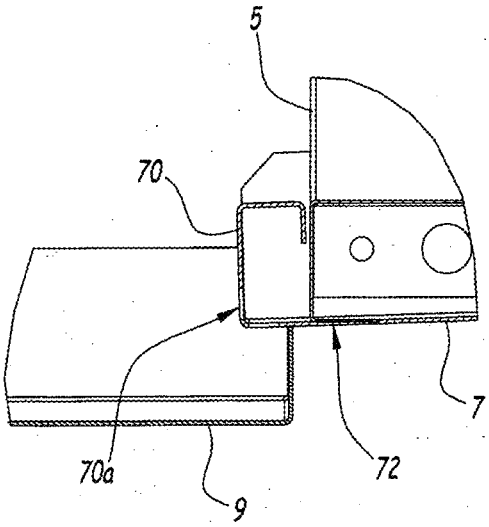
Fig.3 PRIOR ART
Figure 4:
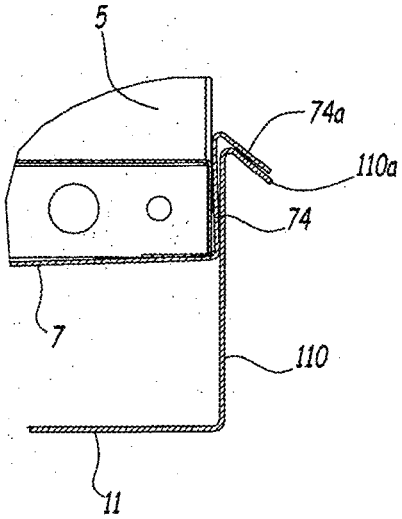
Fig.4 PRIOR ART

FIGS. 2 to 4 show a portion of an air handling unit 1' according to the prior art. Depending on the temperature conditions and relative humidity of the cooled air, condensate may form in the heat exchanger 5 as an adverse side effect. This condensate has to be drained from the enclosure 3. The air handling unit 1' therefore comprises a condensate recuperator 7, formed by a slightly sloped plate with folded side walls. The recuperator 7 is placed under the heat exchanger 5 to collect condensate. A side wall 70 of the recuperator 7 comprises holes 70*a* provided above a condensate tray 9, provided to receive the condensates coming from the recuperator 7.

Due to the geometry of the holes 70*a*, condensate often drips through the holes 70*a* and continues its path along a bottom face 72 of the recuperator 7 due to capillarity, and often drops outside the tray 9.

The recuperator 7 comprises a side wall 74 oriented towards the entry panel 30. The side wall 74 comprises a folded end 74*a*. The recuperator 7 is supported by a holding structure 10. The tray 9 is put on a support member 11 that comprises side wall 110 oriented towards the entry panel 30. The side wall 110 comprises a folded end 110*a* with a shape complementary to the shape of the folded end 74 of the recuperator. The heat exchanger 5 is mounted on the recuperator 7, and the weight of the heat exchanger 5 is supported by the recuperator 7 and transmitted to the holding structure 10.

During transportation of the air handling unit 1', the heat exchanger 5 may move with respect to the recuperator 7 along to the longitudinal direction X, which may cause damages to or break the welding lines that connect the side walls of the recuperator 7 resulting in leakage.

Figure 5:
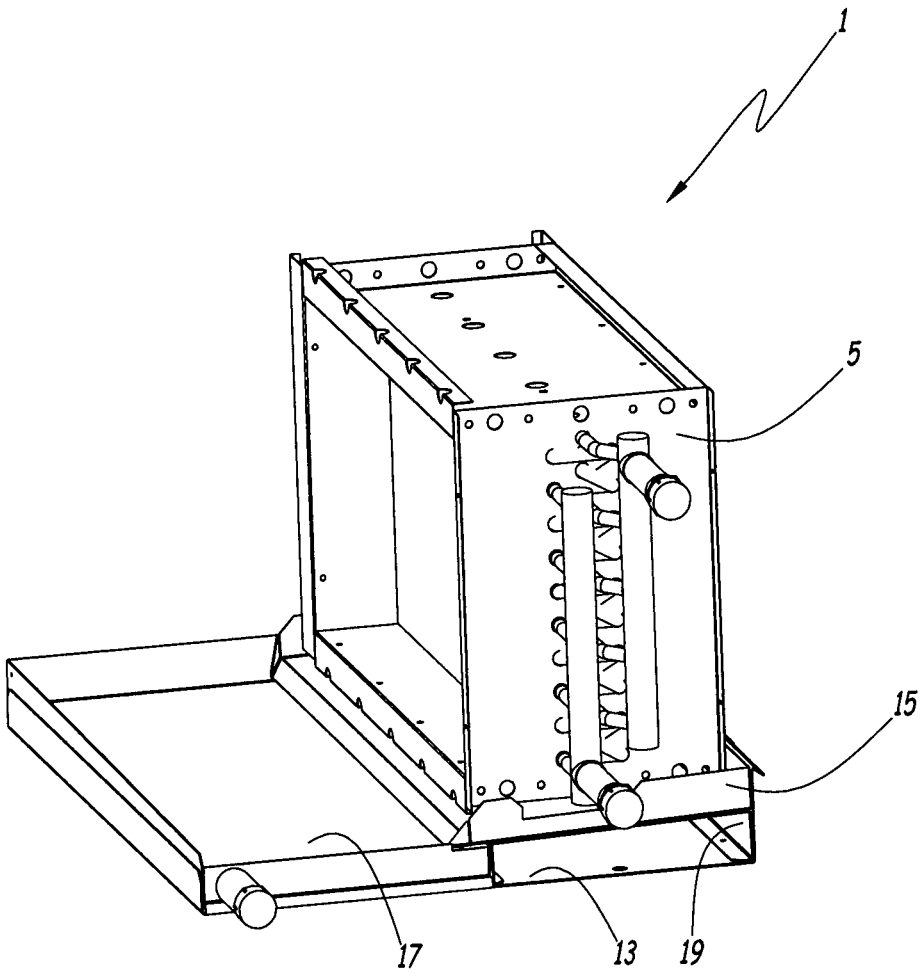
FIG. 5 is a perspective view of a heat exchanger, a condensate recuperator and a condensate tray of the air handling unit of FIG. 1.
Figure 6:
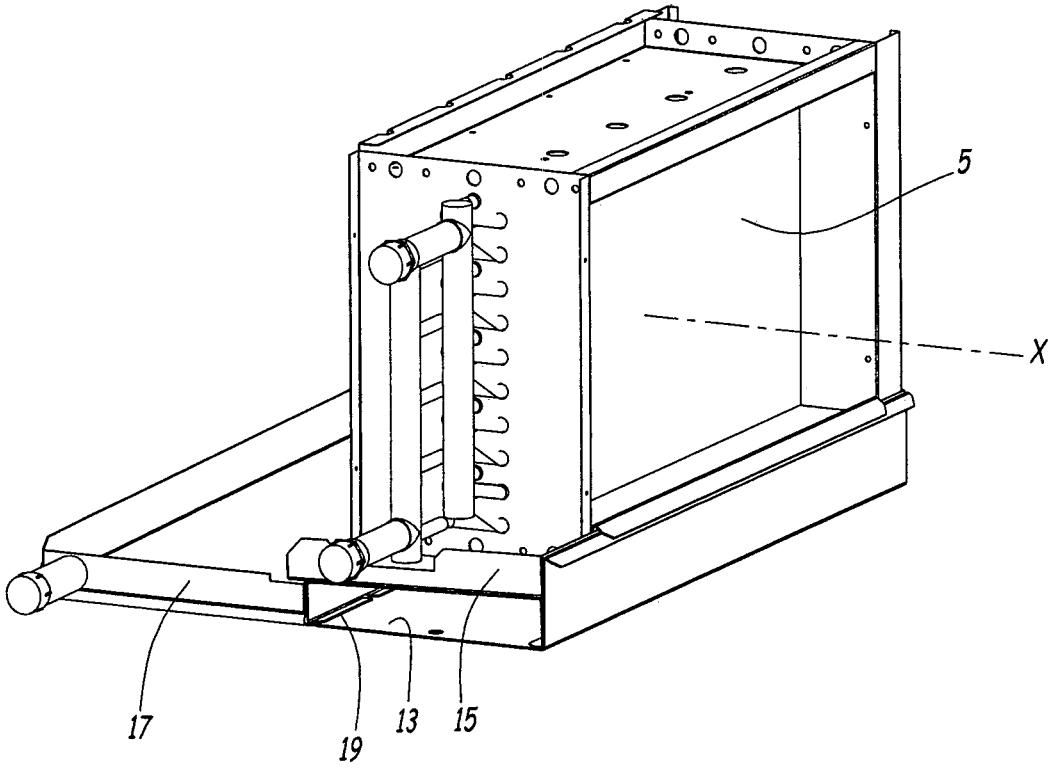
FIG. 6 is a perspective view of the heat exchanger, the condensate recuperator and the condensate tray of FIG. 5, from a different angle.
Figure 7:
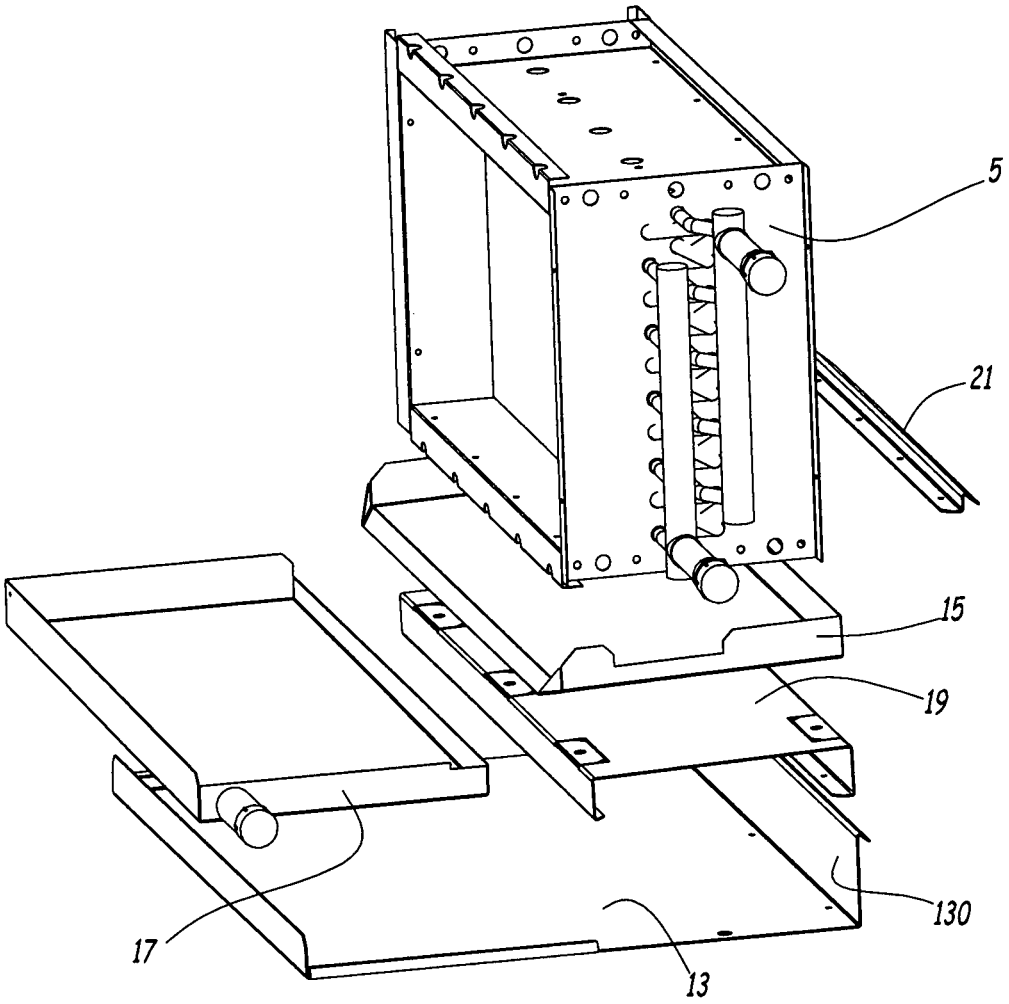
FIG. 7 is an exploded view corresponding to FIG. 5.
Figure 8:
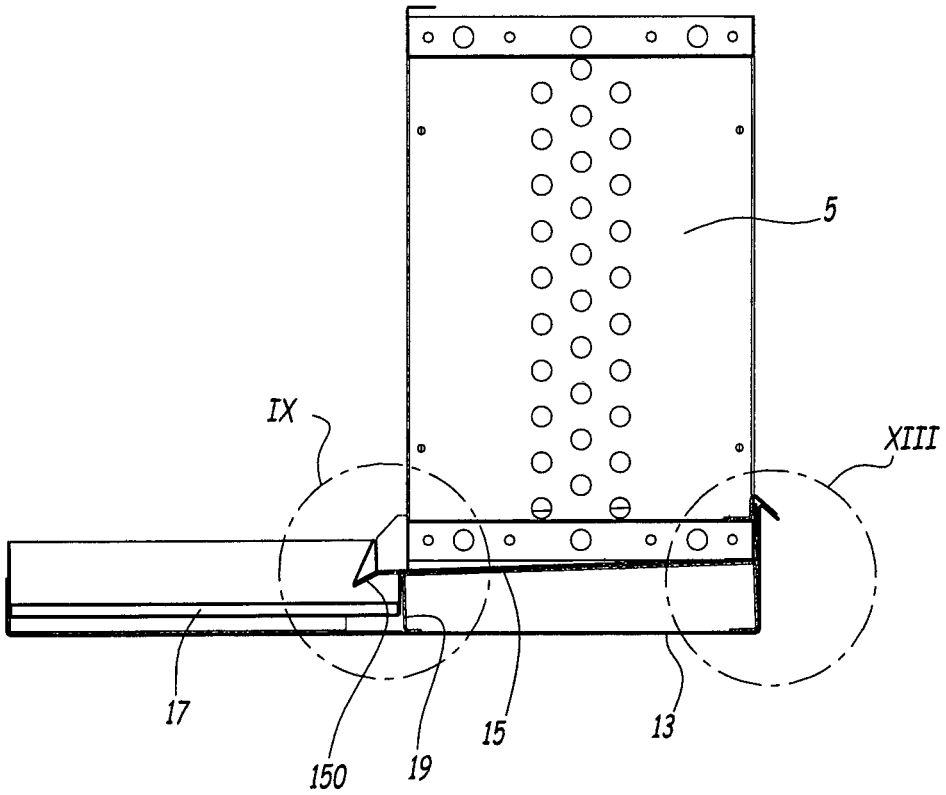
FIG. 8 is a sectional view of the heat exchanger, the condensate recuperator and the condensate tray of FIG. 5.
Figure 9:
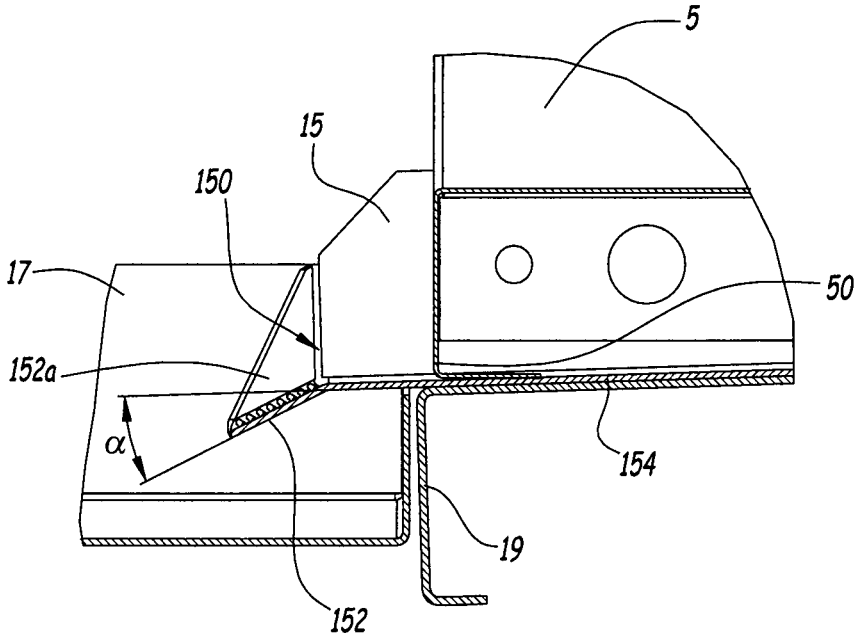
FIG. 9 is a view at a larger scale of detail IX on FIG. 8.

In the present example, as shown in FIG. 5, the air handling unit 1 comprises a support member 13, a condensate recuperator 15, and a condensate tray 17. The condensate recuperator 15 is held in place by a holding structure 19 fixed to the support member 13, shown on FIG. 6 and similar to the holding structure 10. The support member 13 is fixed to the bottom panel 34 by non-shown fastening means. The holding structure 19 is also fixed to the bottom panel 34. The holding structure 19 may be fixed to the bottom panel 34 with non-shown fastening means passing through the support member 13. According to a non-shown variant, the holding structure 19 and the support member 13 may be a unitary element. For example, the holding structure 19 may be formed by a portion of the support member 13.

The holding structure 19 has also the function of supporting the weight of the heat exchanger 5 when the air handling unit 1 is in static position.

As represented on FIGS. 8 to 11, the recuperator 15 has an open side 150 oriented towards the tray 17 and reaching over the tray 17. This open side 150 has an inclined lip 152 guiding the condensate towards the tray 17. The lip 152 comprises lateral portions 152*a* and 152*b* that are bent inwards.

The lip 152 and its inclined shape ensure a correct flow of condensate into the tray 17 and prevent drops of liquid from falling outside the tray 17. The inwardly bent shape of the portions 152*a* and 152*b* helps in guiding the condensate flow towards a central area of the tray 17.

According to an embodiment, the inclined lip 152 has an inclination angle $\alpha$ with respect to a bottom wall 154 of the recuperator 15, comprised between 10° and 80°, preferably equal to 25°.

According to an embodiment, the lateral portions 152*a* and 152*b* are formed by folded parts that are welded to side walls 156 and 157 of the recuperator 15. As shown on FIGS. 9 and 10, the lateral portions 152*a* and 152*b* have a triangular shape connected by one edge to a central portion of the lip 152. The lateral portions 152*a* and 152*b* are manufactured with an initial continuous planar shape with the lip 152, then folded to abut against the side walls 156 and 157. By way of welding the portions 152*a* and 152*b* are then connected to the side walls 156 and 157 respectively.

In order to improve the tightness of the recuperator 15, the mechanical structure of the recuperator 15 is changed. The recuperator 15 does not comprise any folded end 74. The air handling unit 1 comprises a stop member 21 attached to the heat exchanger 5. The stop member 21 may be attached to the heat exchanger 5 by any means, such as screws, rivets or the like.

The stop member 21 comprises sliding means 210 interfacing with sliding means 132 of the support member 13 so that the ensemble formed by the heat exchanger 5 and the stop member 21 can slide with respect to the support member 13 in a direction transversal to the air flow. The stop member 21 acts as a sliding guide, and holds in position the heat exchanger with respect to the support member 13 along the air flow direction X.

The ensemble formed by the heat exchanger 5 and the stop member 21 is mounted in the recuperator 15, with a bottom portion 50 of the heat exchanger 5 resting against the bottom wall 154 of the recuperator 15. The recuperator 15 rests against the holding structure 19 by planar contact allowing sliding transversal movement of the recuperator 15 with respect to the holding structure 19 and the support member 13.

The ensemble formed by the heat exchanger 5, the stop member 21 and the recuperator 15 is therefore able to slide transversally with respect to the support member 13.

In case during transportation the heat exchanger 5 slides longitudinally to the air flow axis X, the stop member 21 cooperates with a portion of the support member 13, namely the sliding means 132, to block the ensemble formed by the heat exchanger 5 and the recuperator 15 with respect to the support member 13 along the longitudinal air flow direction X. The cooperation of the sliding means 132 and 210 transmits the weight of the heat exchanger 5 to the support member 13. The recuperator 15 does not therefore bear anymore the weight of the heat exchanger 5. The risk of shocks against the side walls of the recuperator 15 and the risk of damage to the tightness of the recuperator 15 are therefore reduced.

The recuperator 15 and the heat exchanger 5 forming a sliding ensemble also facilitate the mounting of this ensemble within the enclosure 3.

Making the support member 13 bear the weight of the heat exchanger 5 does not raise tightness issues as the support member 13 does not need to be watertight.

The support member 13 comprises a portion 130 extending transversal to the air flow direction X, and on which the sliding means 132 are formed. The stop member 21 is formed by a part extending transversally to the flow direction X and attached to the bottom portion 50 of the heat exchanger 5. The stop member 21 comprises an attachment portion 212 suitable for planar contact with the bottom portion 50 and attachment to the bottom portion 50.

According to an embodiment, the stop member 21 may be made of folded sheet metal.

Figure 13:
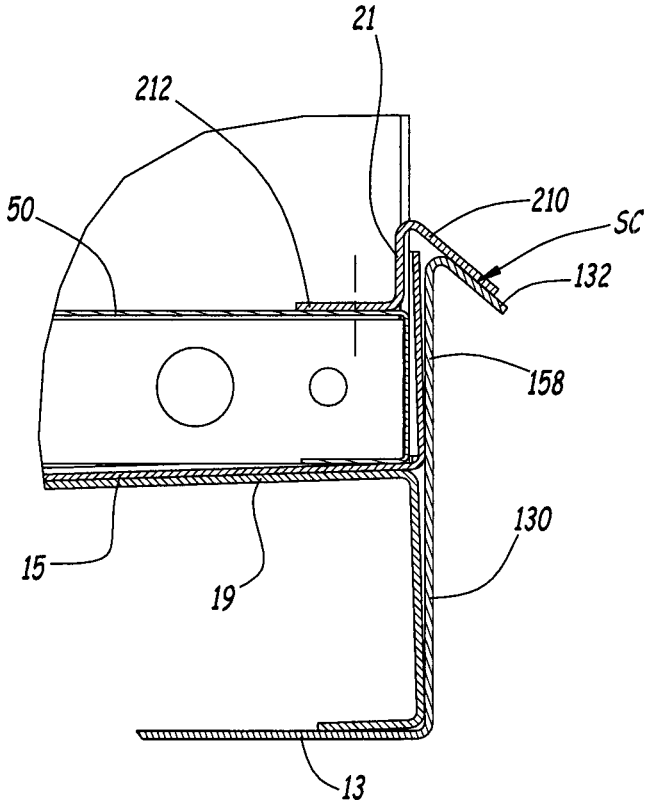
FIG. 13 is a view at a larger scale of detail XIII on FIG. 8.
Figure 10:
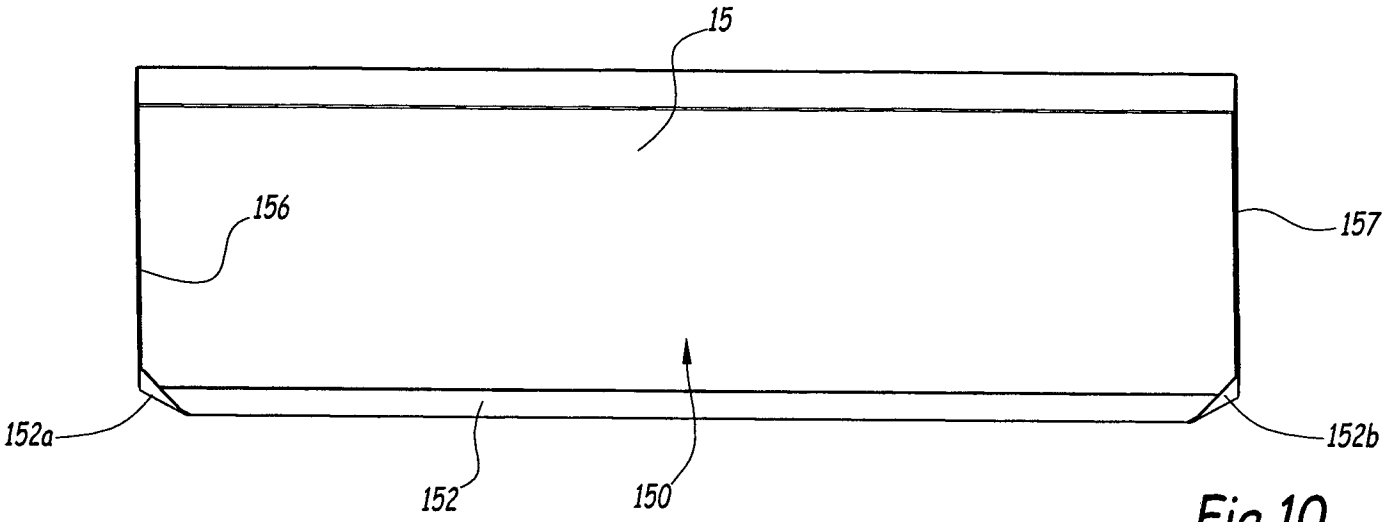
FIG. 10 is a front view of a condensate recuperator of FIG. 5.
Figure 12:
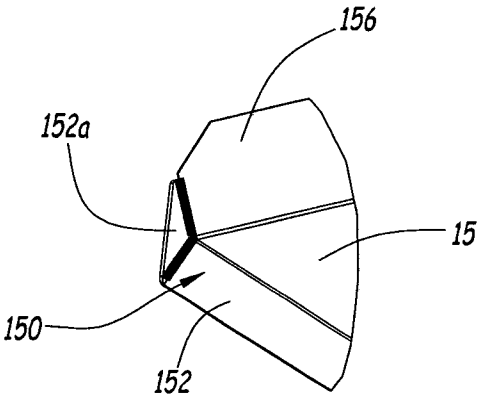
FIG. 12 is a view similar to FIG. 11, after a welding step.
Figure 11:
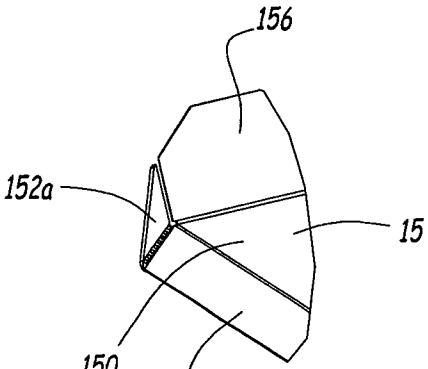
FIG. 11 is a perspective view of a lateral portion of an open edge of the recuperator of FIG. 10 during a manufacturing step.
Figure 15:
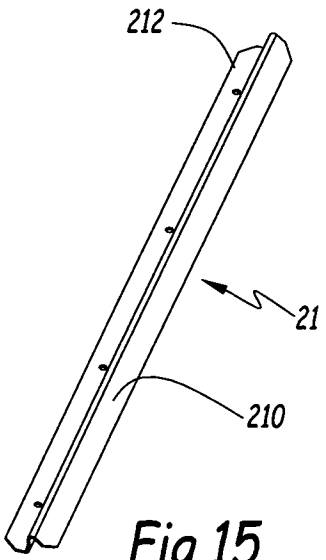
FIG. 15 is a perspective view of a stop member of the air handling unit of FIG. 1.
Figure 14:
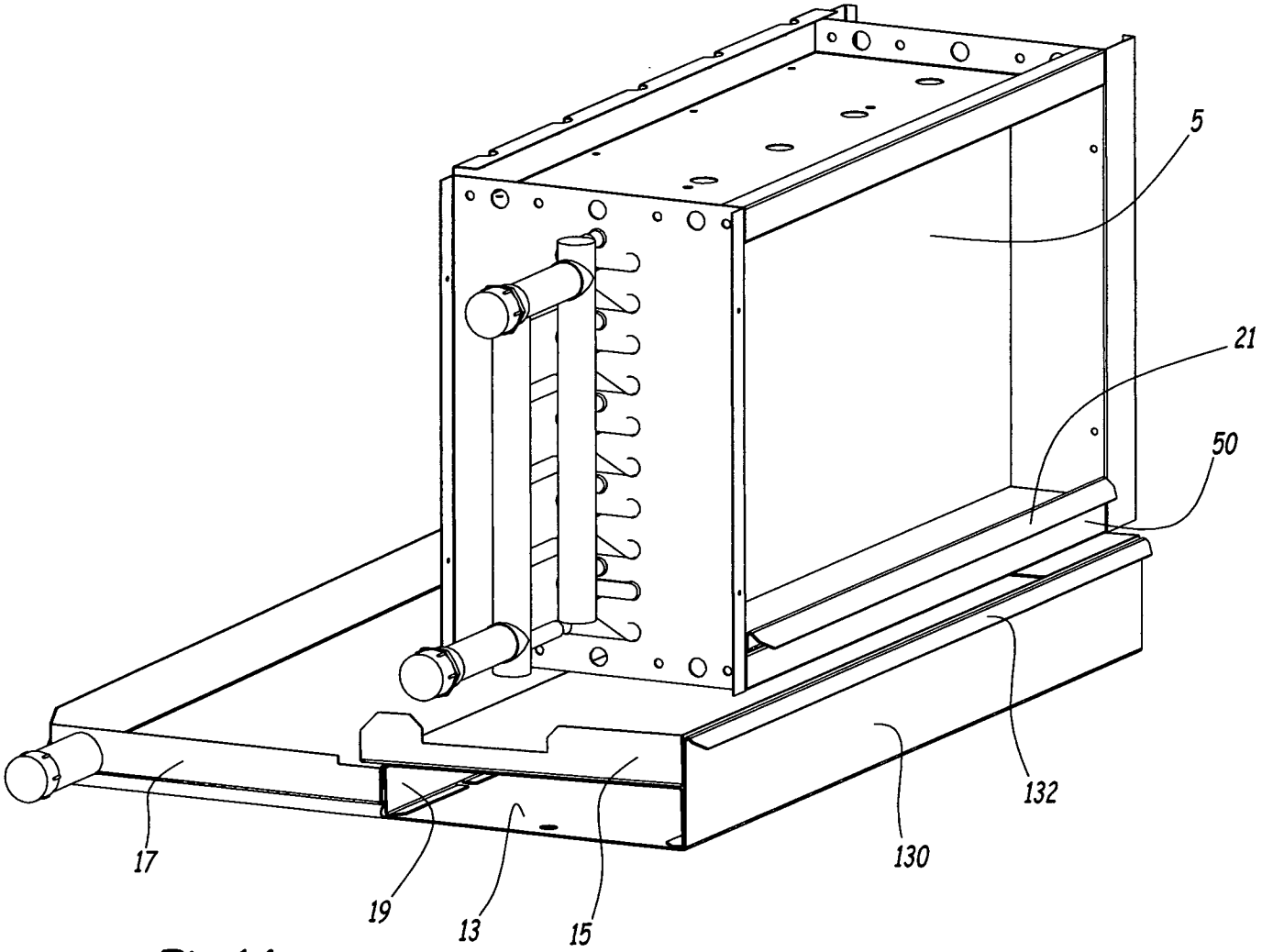
FIG. 14 is a perspective view of the heat exchanger, the condensate recuperator and the condensate tray of FIG. 5, the heat exchanger being raised from the recuperator.

The sliding means 210 and the sliding means 132 have transversal sections of complementary shape. According to an example, the sliding means 210 and the sliding means 132 may have transversal sections of "V" shape, with a surface of contact SC formed by one of the branches of the "V" and represented on FIG. 13. Any other shape adapted to transmit the mechanical stress in the longitudinal direction X while at the same time allowing a sliding movement transversal to the longitudinal direction X can be provided, such as rounded shapes, square shapes or other polygonal shapes, or the like.

On the represented example, a side wall 158 of the recuperator 15, located on the side of the stop member 21, extends between the side wall 130 of the tray 13 and the stop member 21.

According to an embodiment, there may be no mechanical attachment between the heat exchanger 5 and the recuperator 15, the bottom portion 50 of the heat exchanger 5 being simply placed on the bottom face 154.

According to an optional embodiment, the support member 13 comprises a cut-out 134 allowing removable insertion of the condensed liquid tray 17. The tray 17 is removable for purpose of cleaning. The cut out 134 is formed by a reduced dimension of a lateral side wall 136 of the support member 13 with respect to an opposed lateral side wall 138.

Figure 17:
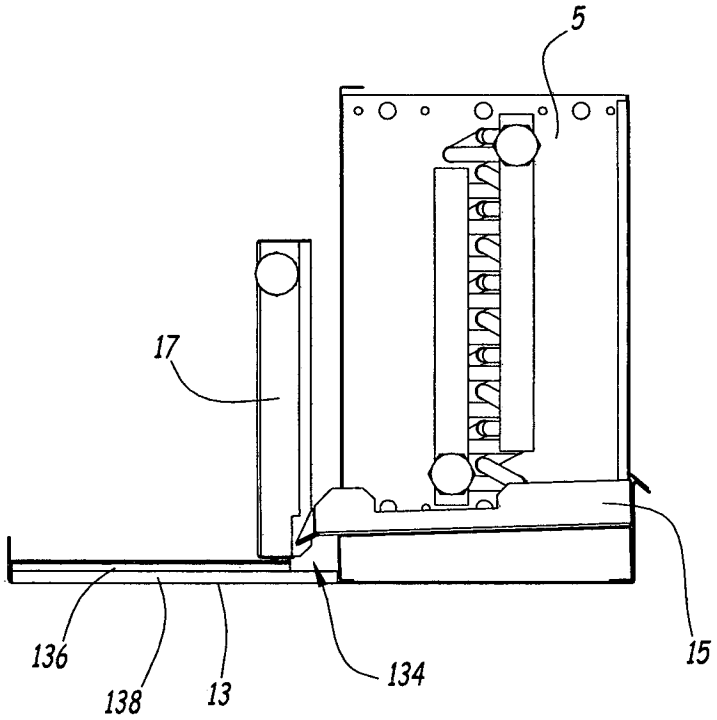
FIGS. 17, 18 and 19 are lateral view of three steps of introducing a removable tray in the support member of FIG. 16.
Figure 16:
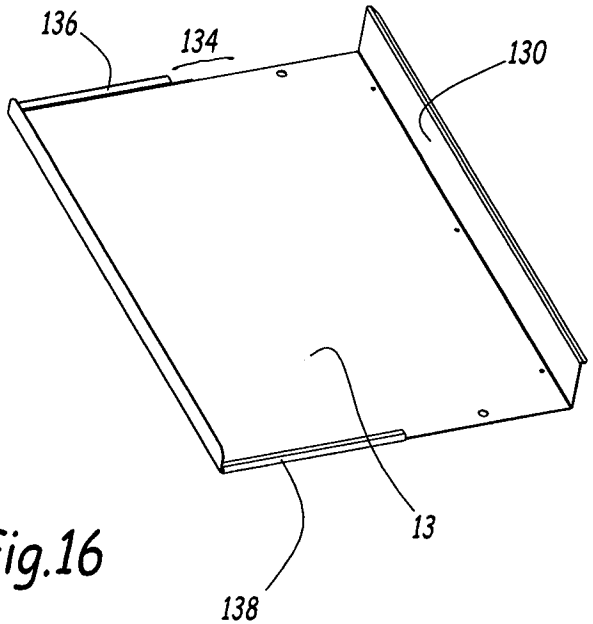
FIG. 16 is a perspective view of a support member of the air handling unit of FIG. 1.
Figure 19:
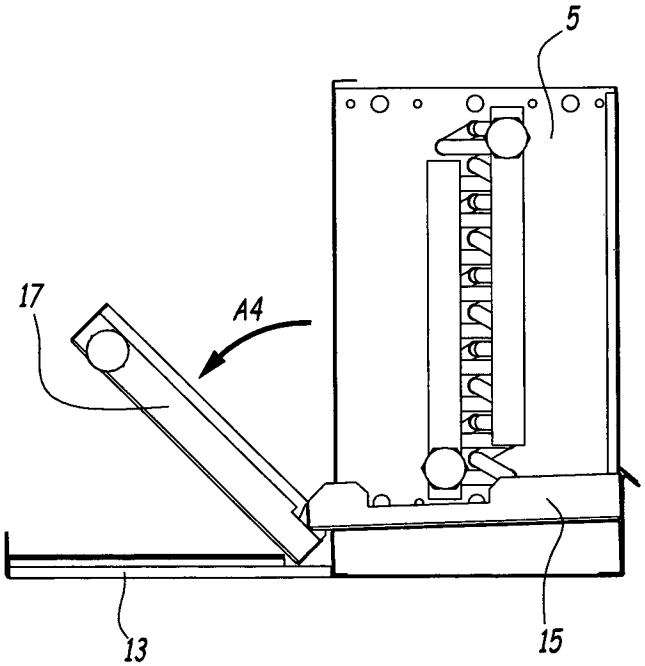
Figure 18:
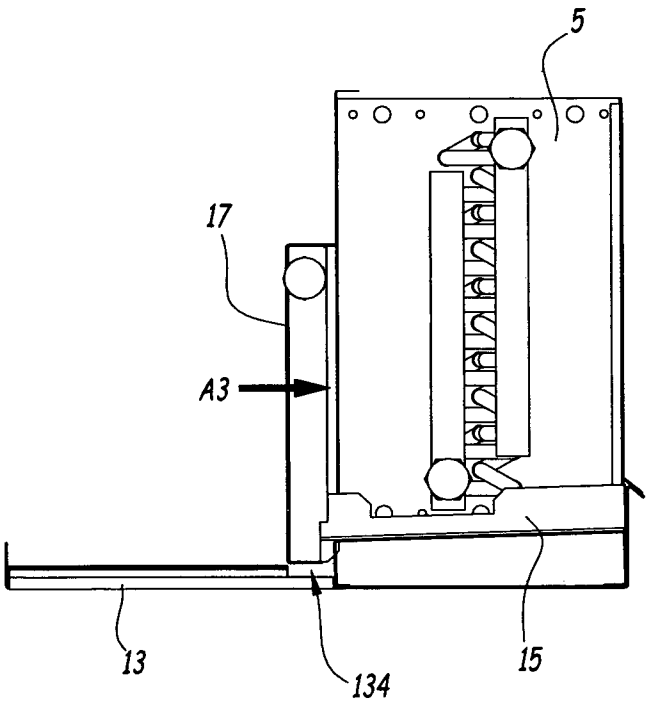

When mounting the tray 17, the tray 17 is positioned vertically in front of the open side 150 of the recuperator 15, as represented on FIG. 17. Then as represented on FIG. 18, the tray 17 is moved along the arrow A3 towards the heat exchanger 5, so that the lip 152 is engaged with the internal volume of the tray 17. Finally, the tray 17 is rotated along the arrow A4, towards its horizontal position. This rotation is permitted by the cut-out 134.

The technical features of the embodiments described here-above can be combined to form new embodiments.

The invention claimed is:

1. Air handling unit (1) comprising:

an enclosure (3) in which air circulates along a flow direction (X);

at least one heat exchanger (5) mounted in the enclosure (3);

a condensate recuperator (15) placed under the at least one heat exchanger (5);

a support member (13, 19) stationary with respect to the enclosure (3), and which supports the condensate recuperator (15);

wherein the air handling unit (1) comprises a stop member (21) attached to the heat exchanger (5), and cooperating with a portion (132) of the support member (13, 19), and wherein the heat exchanger (5) is mounted in the recuperator (15), and an ensemble formed by the heat exchanger (5) and the recuperator (15) is blocked with respect to the support member (13) longitudinally to the flow direction (X) during transportation by the stop member (21);

wherein the stop member (21) comprises sliding means (210) interfacing with sliding means (132) of the support member (13) so that the ensemble formed by the heat exchanger (5) and the recuperator (15) is configured to slide along a linear path with respect to the support member (13) transversal to the flow direction (X);

wherein the sliding means (210) of the stop member (21) and the sliding means (132) of the support member (13) have transversal sections of complementary shape;

wherein the sliding means (210) of the stop member (21) and the sliding means (132) of the support member (13) have transversal sections of "V" shape.

2. Air handling unit according to claim 1, wherein the support member (13) comprises a portion (130) extending transversally to the flow direction (X) and bearing the sliding means (132) of the support member (13).

3. Air handling unit according to claim 1, wherein the stop member (21) is formed by a part extending transversally to the flow direction (X) and attached to a bottom portion (50) of the heat exchanger (5).

4. Air handling unit according to claim 1, wherein the air handling unit (1) comprises a holding structure (19) mounted on the support member (13) and on which the recuperator (15) rests so that the recuperator (15) is configured to slide on the holding structure (19).

5. Air handling unit according to claim 1, wherein the stop member (21) is made of folded sheet metal.

6. Air handling unit according to claim 1, wherein the air handling unit (1) comprises a condensate tray (17) adapted to receive condensate from the recuperator (15), and wherein the support member (13) comprises a cut-out (134) allowing removable insertion of the condensate tray (17).

7. Air handling unit according to claim 1, wherein the air handling unit (1) comprises a condensate tray (17) adapted to receive condensate from the recuperator (15), and wherein the recuperator (15) has an open side (150) oriented towards the tray (17) and reaching over the tray (17), and wherein this open side (150) has an inclined lip (152) guiding the condensate towards the tray (17), and wherein the lip (152) has lateral portions (152*a*, 152*b*) that are bent inwards.

8. Air handling unit according to claim 1, wherein the sliding means (210) and sliding means (132) of the support member (13) extend in parallel along a lateral axis of the enclosure (3), the lateral axis of the enclosure being perpendicular to the flow direction (X).

* * * * *